US005782682A

United States Patent [19]

Han et al.

[11] Patent Number: 5,782,682

[45] Date of Patent: Jul. 21, 1998

[54] GRINDING WHEEL HAVING ABRASIVE TIPS

[75] Inventors: Jung Su Han, Paldal-ku; So Young Yun, Seoul, both of Rep. of Korea

[73] Assignee: EHWA Diamond Ind. Co. Ltd., Rep. of Korea

[21] Appl. No.: 657,277

[22] Filed: Jun. 4, 1996

[30] Foreign Application Priority Data

Jun. 9, 1995 [KR] Rep. of Korea ..... 1995 15165

[51] Int. Cl.[6] ..... B24B 5/00

[52] U.S. Cl. ..... 451/548; 451/551; 451/527; 451/529

[58] Field of Search ..... 125/3, 28; 451/540, 451/548, 551, 527, 529

[56] References Cited

U.S. PATENT DOCUMENTS

| | | | |
|---|---|---|---|
| 1,751,930 | 3/1930 | Legge . | |
| 2,225,193 | 12/1940 | Benner et al. | 451/548 X |
| 2,309,016 | 1/1943 | Ryan | 451/548 |
| 2,442,129 | 5/1948 | Hollstrom | 451/548 |
| 3,121,982 | 2/1964 | Miller | 451/548 |
| 3,317,416 | 5/1967 | Warren | 451/548 X |
| 3,318,053 | 5/1967 | Miller | 451/548 |
| 3,482,791 | 12/1969 | Alliegro | 451/548 X |
| 5,431,596 | 7/1995 | Akita et al. | 451/548 X |
| 5,496,209 | 3/1996 | Gaebe | 451/548 |

FOREIGN PATENT DOCUMENTS

| | | | |
|---|---|---|---|
| 6256 | 8/1956 | Estonia | 451/548 |
| 55-120980 | 9/1980 | Japan | 451/548 |
| 493340 | 11/1975 | U.S.S.R. | 451/548 |

*Primary Examiner*—Timothy V. Eley
*Attorney, Agent, or Firm*—Vidas, Arrett & Steinkraus, P.A.

[57] ABSTRACT

A grinding wheel with tips which can be uniformly abraded regardless of the position of the tips is disclosed. In the wheel, the inside and outside tips may be formed by bonding diamond dust of the same concentration with resinoid or metal bonds of lower and higher abrasion resistances, respectively. Alternatively, the inside and outside tips may be formed using the same resinoid or metal bond. In this case, the outside tips are laden with diamond dust, while the inside tips are laden with no diamond dust or cheap abrasive. As a further alternative, the concentration of the diamond dust of the tips may be stepwisely reduced from the outside toward the inside. In addition, the top surface of each tip may be inclined downward from the outside toward the inside to compensate for the eccentric abrasion of the tips due to the circumferential speed difference between the inside and outside tips.

4 Claims, 3 Drawing Sheets

GRINDING WHEEL HAVING ABRASIVE TIPS

BACKGROUND OF THE INVENTION

1. Field of the Invention

The present invention relates in general to grinding wheels or diamond wheels especially used for grinding the surfaces of stones and, more particularly, to a structural improvement in such grinding wheels for causing the grinding wheels to be uniformly abraded thereby improving the grinding work efficiency and lengthening the expected life span of the grinding wheels.

2. Description of the Prior Art

As well known to those skilled in the art, grinding wheels used for grinding the surfaces of stones are generally classified into two types, that is, grinding wheels for grinding curved surfaces of stones as shown in FIGS. 1*a* and 1*b* and grinding wheels for grinding plane surfaces of stones as shown in FIGS. 2*a* and 2*b*.

The grinding wheels 2, 4 for grinding rough surfaces of stones have tips 22, 42 which are formed by bonding diamond dust as the abrasive using metal powder or metal bond, while the grinding wheels 1, 3 for grinding fine surfaces of stones have tips 12, 32 which are formed by bonding diamond dust as the abrasive using resinoid powder or resinoid bond. The above grinding wheels are selectively used in accordance with the surface conditions of a stone to be ground. Each of the grinding wheels is typically installed on the rotary head of a grinding machine in order to grind the surface of the stone.

While grinding a stone, the grinding wheel comes into frictional contact with the surface of the stone while at the same time rotating, thus grinding the surface of the stone. In the typical grinding wheels, the circumferential speed of the inside portion near the center of each wheel is lower than that of the outside portion, so that the edge portion of the wheel meets with the highest frictional resistance and thereby is most quickly abraded. In the grinding wheels for grinding the curved surfaces of the stones as shown in FIGS. 1*a* and 1*b*, the edge portion of each wheel is worn out far in advance of the other portions of the wheel, so the wheel becomes a small diameter wheel and thereby has lost its usefulness.

Meanwhile in the case of the grinding wheels for grinding the plane surfaces of the stones as shown in FIGS. 2*a* and 2*b*, the tips arranged in the portions far away from the center of each wheel meet with the highest frictional resistance, so those tips are worn out far in advance of the tips in the other portions of the wheel. Therefore, the grinding surface of the wheel fails to come into uniform contact with the surface of the stone to be ground. The grinding wheel with the nonuniformly-abraded tips thus fails to precisely grind the surface of the stone and thereby deteriorates the precision of the grinding operation.

SUMMARY OF THE INVENTION

It is, therefore, an object of the present invention to provide a high quality grinding wheel in which the above-mentioned problems can be overcome and whose diamond-laden tips can be uniformly abraded by either changing the concentration of diamond dust (or the content of the diamond dust per unit volume of each tip) or changing the material of the bond for bonding the diamond dust, thereby effectively performing the grinding operation and providing a high precision in the plane surface grinding operation.

In order to accomplish the above object, the present invention provides a grinding wheel which is provided with a plurality of tips suitable to be uniformly abraded regardless of the position of the tips. In an embodiment, the inside and outside tips of the wheel may be formed by bonding diamond dust of the same concentration with resinoid or metal bonds of different abrasion resistances. That is, the diamond dust as the abrasive of the outside tips is bonded with a higher abrasion resistance, while the diamond dust of the inside tips is bonded with a lower abrasion resistance. In another embodiment, the inside and outside tips of the grinding wheel may be formed using the same resinoid or metal bond. In this embodiment, the outside tips are laden with diamond dust as the abrasive, while the inside tips are laden with no diamond dust or cheap abrasive. Alternatively, the concentration of the diamond dust of the inside and outside tips having the same resinoid or metal bond may be stepwisely reduced from the outside toward the inside of the wheel.

In a further embodiment, the top surface of each tip may be inclined downward from the outside toward the inside. The above inclined top surface of each tip effectively compensates for the eccentric abrasion of the tips caused by the difference of the circumferential speed between the inside and outside portions of the wheel.

The present invention provides two types of grinding wheels, that is, a curved surface grinding wheel and a plane surface grinding wheel.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1B:
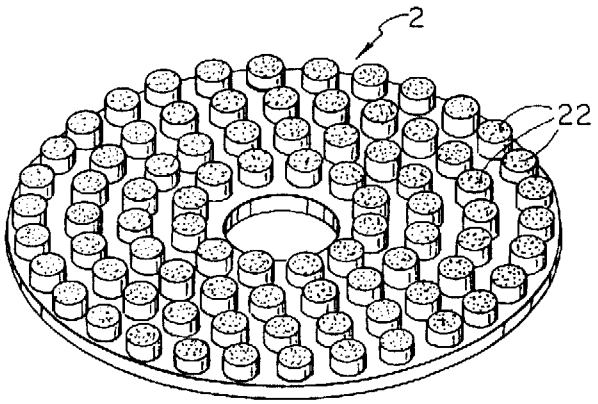
FIGS. 1*a* and 1*b* are perspective views showing the construction of grinding wheels used for grinding fine and rough curved surfaces of stones in accordance with the present invention, respectively.
Figure 1A:
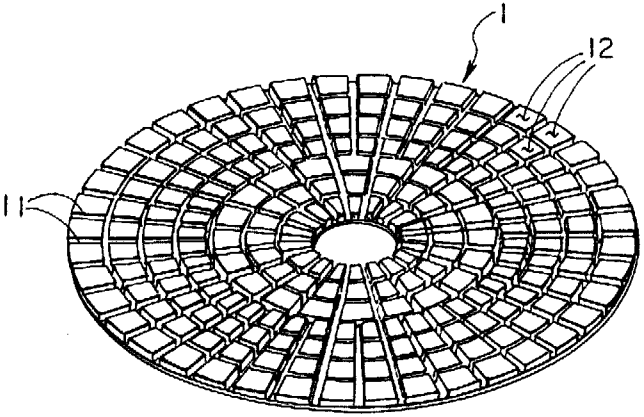

FIG. 1*a* is a perspective view showing the construction of a diamond wheel or grinding wheel 1 used for grinding a fine curved surface of a stone in accordance with an embodiment of the present invention. In the above wheel 1, diamond dust as the abrasive is bonded to resinoid bond bases thus forming a plurality of flat tips 12 on a disc-shaped sheet. The above resinoid bond bases are uniformly arranged on the sheet with a plurality of concentric and radial grooves 11, so the resulting tips 12 are uniformly arranged on the sheet with the concentric and radial grooves 11.

FIG. 1*b* is a perspective view showing the construction of a grinding wheel 2 used for grinding a rough curved surface of a stone in accordance with another embodiment of the present invention. In the above wheel 2, diamond dust is bonded to a plurality of cylindrical metal bond bases uniformly arranged on a disc-shaped sheet thus forming a plurality of cylindrical tips 22 on the sheet. In each of the above grinding wheels 1 and 2, the tips 12, 22 must be constructed to be uniformly abraded and thereby effectively perform the grinding operation for a lengthy period of time. The above object may be achieved by stepwisely reducing the concentration of the diamond dust in the tips 12, 22 from the outside toward the inside of the grinding wheel. That is, the concentration of the diamond dust is stepwisely changed in a way such that the tips 12, 22 in the outermost portion of the wheel 1, 2 have the highest concentration, while the tips 12, 22 in the innermost portion of the wheel 1, 2 have the lowest concentration. Alternatively, the uniform abrasion of the tips 12, 22 may be achieved by uniformly distributing the diamond dust to the tips arranged on the outer portion of the wheel 1, 2 while distributing no diamond dust or a more inexpensive abrasive to the tips 12, 22 arranged on the inside portion of the wheel 1, 2.

As a further alternative, the uniform abrasion of the tips 12, 22 may be achieved by bonding the diamond dust of the outside tips of the wheel 1, 2 with resinoid or metal bond having a high abrasion resistance while bonding the diamond dust of the inside tips with resinoid or metal bond having a low abrasion resistance.

Figure 3A:
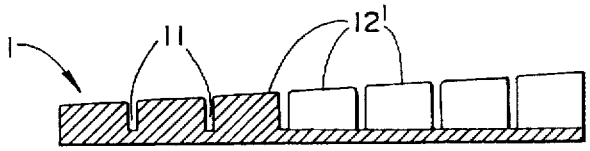
FIGS. 3*a* and 3*b* are partially-sectioned views of the grinding wheels of FIGS. 1*a* and 1*b*, respectively.
Figure 3B:
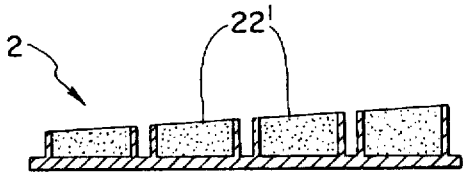

On the other hand, the uniform abrasion of the tips may be achieved by changing the configuration of the tips as shown in FIGS. 3*a* and 3*b*. That is, the tips 12', 22' suitable to be uniformly abraded may be formed by bonding the diamond dust of the same concentration using the bond while giving an inclined top surface to each tip. The top surface of each tip 12', 22' is inclined downward from the outside toward the inside. Due to such an inclined top surface of each tip, the tips 12', 22' may compensate for the eccentric abrasion caused by the difference of the circumferential speed between the tips 12', 22' of the inside and outside portions. The grinding wheel 1, 2 with the above tips 12', 22' thus effectively perform the grinding operation for a lengthy period of time.

Figure 2B:
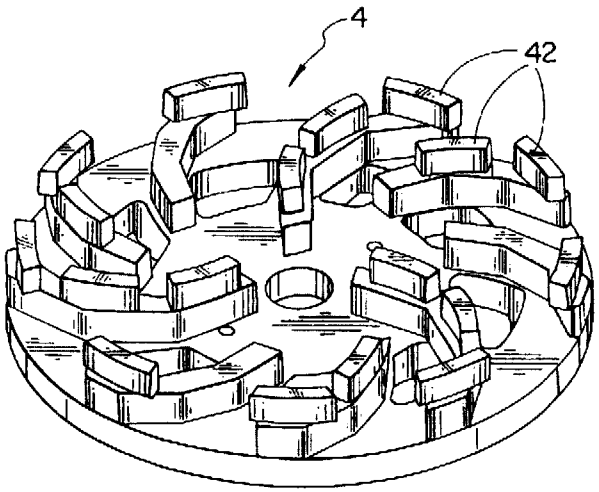
FIGS. 2*a* and 2*b* are perspective views showing the construction of grinding wheels used for grinding fine and rough plane surfaces of stones in accordance with the present invention, respectively.
Figure 2A:
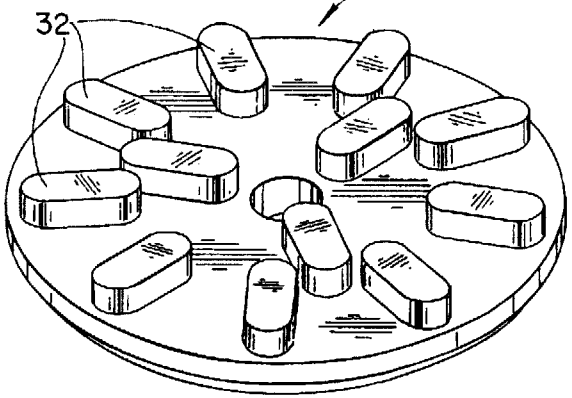

FIG. 2*a* is a perspective view showing the construction of a grinding wheel 3 used for grinding a fine plane surface of a stone in accordance with a further embodiment of the present invention. In the above grinding wheel 3, a plurality of tips 32 which are formed by bonding diamond dust as the abrasive using the resinoid bond are uniformly arranged on a disc-shaped sheet. The tips 32 are arranged on the inside and outside portions and radially directed, and spaced out at regular intervals. FIG. 2*b* is a perspective view showing the construction of a grinding wheel 4 used for grinding a rough plane surface of a stone according to still another embodiment of the present invention. In the above wheel 4, a plurality of smoothly-curved tips 42 which are formed by bonding diamond dust using the metal bond are regularly arranged on a disc-shaped sheet to form an involute configuration. In the same manner as described for the wheels 1 and 2 of FIGS. 1*a* and 1*b*, the uniform abrasion of the tips 32, 42 may be achieved by stepwisely reducing the concentration of the diamond dust in the tips 32, 42 from the outside toward the inside. Alternatively, the uniform abrasion of the tips 32, 42 may be achieved by uniformly distributing the diamond dust of the same concentration to the outside tips while distributing no diamond dust or cheap abrasive to the inside tips.

As a further alternative, the uniform abrasion of the tips 32, 42 may be achieved by bonding the diamond dust of the outside tips using resinoid or metal bond having a high abrasion resistance while bonding the diamond dust of the inside tips using resinoid or metal bond having a low abrasion resistance. In order to allow users to easily distinguish the inside portion from the outside portion of each wheel 1, 2, 3, 4, the tips 12, 32 of the wheel 1, 3 may have different colors or brightnesses, while the tip-carrying sheet of the wheel 2, 4 may have different colors or brightnesses. The above grinding wheels 1, 2, 3 and 4 thus allow the users to easily distinguish the wheels and are convenient to the users.

As described above, the present invention provides a structurally improved grinding wheel suitable for being uniformly abraded and thereby overcoming the problems caused by the typical grinding wheels. That is, the grinding wheel used for grinding a curved surface according to this invention can be uniformly abraded and thereby effectively overcomes the problem of the typical grinding wheels in that the edge portion of a typical grinding wheel is worn out far in advance of the inside portion of the wheel due to either a worker's operational custom or the difference of the circumferential speed between the inside and outside portions of the wheel, which rotate at the same rpm, thereby making the typical wheel become a useless wheel having a small diameter. Therefore, the grinding wheel of this invention can be used for a longer period of time in comparison with the typical grinding wheels. The grinding wheel of this invention is uniformly abraded by giving different abrasion resistances or diamond concentrations to the inside and outside tips of the wheel. Therefore, the grinding wheel of this invention can appropriately perform the grinding operation for a lengthy period of time.

Another embodiment of the present invention provides a grinding wheel used for grinding a plane surface. The plane surface grinding wheel of this invention is uniformly abraded in the same manner as described for the curved surface grinding wheel, so that the plane surface grinding wheel is prevented from rocking from side to side while grinding due to eccentric abrasion of the wheel. The above plane surface grinding wheel thus provides a high precision in a plane surface grinding operation.

In accordance with an operational performance test for the grinding wheels of this invention, the curved surface grinding wheel was proved to not only remarkably improve the grinding operational effect but also to lengthen the expected life span by about 30% in comparison with the typical wheels under the same work conditions.

In addition, the plane surface grinding wheel of this invention obtained the operational effect similar to that of the above curved surface grinding wheel. That is, the plane surface grinding wheel remarkably improves the grinding operational effect and lengthens the expected life span. The above plane surface grinding wheel also achieved a high precision in a plane surface grinding operation.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A grinding wheel having a plurality of abrasive tips arranged radially over one side of a disc-shaped sheet, said disc-shaped sheet having an outer periphery and a center, wherein said tips have different concentrations of diamond dust in a way such that the concentration of the diamond dust decreases from tips being near the outer periphery toward tips being near the center of the sheet.

2. The grinding wheel according to claim 1, wherein tips being near the center of said sheet are laden with a non-diamond abrasive instead of diamond dust.

3. The grinding wheel according to claim 1, wherein the tips arranged on the outer periphery of said sheet are formed using a metal or resinoid bond having a higher abrasion resistance, while the tips arranged on the center of said sheet are formed using a metal or resinoid bond having a lower abrasion resistance.

4. The grinding wheel according to claim 1, wherein the tips arranged on the outer periphery and near the center of said sheet have different colors and/or different brightnesses.

* * * * *